United States Patent [19]

Okazaki et al.

[11] Patent Number: 4,960,683

[45] Date of Patent: Oct. 2, 1990

[54] METHOD FOR PROCESSING A BLACK-AND-WHITE PHOTOSENSITIVE MATERIAL

[75] Inventors: Masaki Okazaki; Akihiko Ikegawa; Minoeu Yamada; Kunio Steo, all of Kanagawa, Japan

[73] Assignee: Fuji Photo Film Co., Ltd., Kanagawa, Japan

[21] Appl. No.: 212,995

[22] Filed: Jun. 29, 1988

[30] Foreign Application Priority Data

| | | | |
|---|---|---|---|
| Jun. 29, 1987 | [JP] | Japan | 62-161478 |
| Jul. 9, 1987 | [JP] | Japan | 62-171795 |
| Jul. 17, 1987 | [JP] | Japan | 62-178701 |
| Jul. 30, 1987 | [JP] | Japan | 62-191312 |

[51] Int. Cl.[5] ..... G03C 5/38

[52] U.S. Cl. ..... 430/428; 430/427; 430/432; 430/445; 430/446; 430/372; 430/463

[58] Field of Search ..... 430/445, 446, 427, 428, 430/432, 372, 463

[56] References Cited

U.S. PATENT DOCUMENTS

| | | | |
|---|---|---|---|
| 3,645,738 | 2/1972 | Willems et al. | 96/61 |
| 3,718,468 | 2/1973 | Berthold et al. | 96/50 |
| 4,525,449 | 6/1985 | Nakajima et al. | 430/407 |
| 4,760,015 | 6/1988 | Berthold et al. | 430/432 |

FOREIGN PATENT DOCUMENTS

| | | | |
|---|---|---|---|
| 766184 | 8/1967 | Canada | 96/50 |
| 1147845 | 9/1962 | Fed. Rep. of Germany . | |
| 1351410 | 12/1963 | France . | |
| 57-63530 | 4/1982 | Japan . | |
| 58-114035 | 7/1983 | Japan . | |
| 59-201056 | 11/1984 | Japan . | |
| 61-83534 | 4/1986 | Japan . | |
| 62-59952 | 3/1987 | Japan . | |
| 1020032 | 2/1966 | United Kingdom . | |

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A method for processing a black-and-white photosensitive material comprising the steps of:

(a) exposing a silver halide photosensitive material having been spectrally sensitized with a sensitizing dye;
(b) developing the exposed material;
(c) fixing the developed material; and
(d) thereafter at least one step selected from washing the material and stabilizing the material;

at least one of the fixing, washing and stabilizing steps being performed in the presence of at least one compound represented by formula (I) or (II) or a salt thereof;

(I)

wherein A represents an atomic group necessary for forming a saturated or unsaturated 3-membered to 8-membered ring comprising at least one hetero atom selected from an oxygen atom, a nitrogen atom, a sulfur atom and a selenium atom; and M represents a hydrogen atom or a counter cation; and $$X—(R_1—S)_n—R_2—S—R_3—Y \quad (II)$$

wherein $R_1$, $R_2$ and $R_3$, which may be the same or different, each represents an alkylene group; $R_1$ and $R_3$ may be linked to form a ring, $R_2$ and $R_3$ may be linked to form a ring; X and Y, which may be the same or different, each represents a hydrogen atom, an alkyl group, an amino group, an ammonio group, a hydroxyl group, a carboxyl group, a sulfo group, an aminocarbonyl group or an aminosulfonyl group, and X and Y may be linked to form a ring; and n is an integer of from 0 to 10.

24 Claims, 1 Drawing Sheet

METHOD FOR PROCESSING A BLACK-AND-WHITE PHOTOSENSITIVE MATERIAL

FIELD OF THE INVENTION

The present invention relates to a method for processing a black-and-white photosensitive material, and more particularly, to a photographic processing method which ensures reduction of color contamination.

BACKGROUND OF THE INVENTION

Increased efficiency has come to be required of all arts with the progress and development of electronics, and the art of silver halide photographic processing is no exception to this trend.

In particular, rapid photographic processing of sheet form sensitive materials, such as photosensitive materials for graphic arts, X-ray sensitive materials, scanner photosensitive materials and CRT image-recording photosensitive materials, is increasingly required.

Moreover, a smaller volume tank suffices for photographic processing of a unit area of photosensitive material per unit time the more rapidly the photographic processing is performed. That is, rapid photographic processing has the advantage that it can contribute to miniaturization of an automatic developing machine, so it is of a great significance.

However, the speeding-up of photographic processing is attended by the serious problem that a sensitizing dye contained in a silver halide photosensitive material cannot be completely eluted during photographic processing, and remains in the photosensitive material as "color contamination".

An optically exposed black-and-white silver halide photosensitive material is generally subjected, in sequence, to development, fixation and washing processings, and has conventionally required a great quantity of water in the washing processing. This requirement is undesirable from the standpoints of conservation of water and energy, and imposes a great restriction on the space required to install an automatic developing apparatus. Accordingly, it has been desired to effect washing processing with a small amount of water, or to process with a stabilizer without undergoing any substantial washing processing.

SUMMARY OF THE INVENTION

A first object of the present invention is to provide a method for rapidly processing a black-and-white silver halide photosensitive material.

A second object of the present invention is to provide a photographic processing method which prevents color contamination with a residual sensitizing dye in rapid processing.

A third object of the present invention is to provide a photographic processing method which uses a small quantity of washing water or stabilizer.

Other objects of the present invention will be apparent from the following description.

The above objects of the present invention can be attained by a method for processing a black-and-white photosensitive material comprising the steps of:

(a) exposing a silver halide photosensitive material having been spectrally sensitized with a sensitizing dye;

(b) developing the exposed material;

(c) fixing the developed material; and (d) thereafter at least one step selected from washing the material and stabilizing the material;

at least one of the fixing, washing and stabilizing steps being performed in the presence of at least one compound represented by formula (I) or (II) or a salt thereof:

(I)

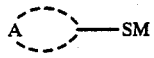

wherein A represents an atomic group necessary for forming a saturated or unsaturated 3-membered to 8-membered ring comprising at least one hetero atom selected from an oxygen atom, a nitrogen atom, a sulfur atom and a selenium atom; and M represents a hydrogen atom or a counter cation; and $$X—(R_1—S)_n—R_2—S—R_3—Y \quad \text{(II)}$$

wherein $R_1$, $R_2$ and $R_3$, which may be the same or different, each represents an alkylene group; $R_1$ and $R_3$ may be linked to form a ring, $R_2$ and $R_3$ may be linked to form a ring; X and Y, which may be the same or different, each represents a hydrogen atom, an alkyl group, an amino group, an ammonio group, a hydroxyl group, a carboxyl group, a sulfo group, an aminocarbonyl group or an aminosulfonyl group, and X and Y may be linked to form a ring; and n is an integer of from 0 to 10.

DETAILED DESCRIPTION OF THE INVENTION

Figure 1:
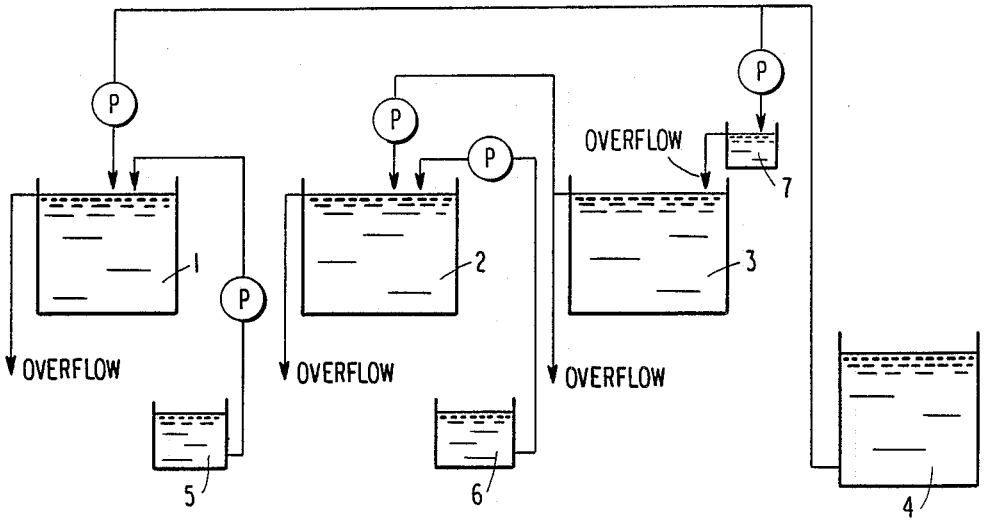
FIG. 1 shows one of the embodiments of the automatic developing system for performing the method of the present invention, wherein 1 designates a developing tank, 2 a fixing tank, 3 a washing tank, 4 a water stock tank, 5 a concentrated liquid developer stock tank, 6 a concentrated liquid fixer stock tank, 7 a squeeze roller washing trough, and P a pump.

In formula (I), it is preferred that the group —SM be attached to a carbon atom which is a member of the ring formed by A.

The ring completed by A may have one or more substituent groups, and two or more of such substituents may be linked to form a second saturated or unsaturated 3- to 8-membered ring condensed with the ring formed by A.

As examples of a 3- to 8-membered ring formed by A, nitrogen-containing rings are preferred. Specific examples of preferred rings include a pyrrole ring, an imidazole ring, a triazole ring, a thiadiazole ring, a tetrazole ring, a thiazole ring, a thiazoline ring, a benzothiazole ring, a benzimidazole ring, a benzoselenazole ring, a benzoxazole ring, a pyridine ring, a pyrimidine ring, a tetrahydropyrimidine ring, a triazine ring, a quinoxaline ring, a tetraazaindene ring, a pyrazolotriazole ring, and the like.

Specific examples of groups with which A can be substituted include hydroxyl groups, alkoxy groups, aryloxy groups, carboxyl groups, amino groups (including substituted ones), ammonio groups (including substituted ones), sulfo groups, phosphono groups, sulfonyl groups, ureido groups, acyl groups, mercapto groups, alkylthio groups, arylthio groups, carbamoyl groups (including substituted ones), sulfamoyl groups (including substituted ones), acylamino groups, sulfonamido groups, oxo groups, halogen atoms, cyano groups, nitro groups, alkyl groups, alkenyl groups, alkynyl groups, and aryl groups. These substituent groups may be further substituted with another of the above-cited substituent groups, if possible. Among the functional groups with which the compound of formula (I) can be substituted, carboxyl, sulfo and phosphono groups may assume the form of an alkali metal salt (e.g., a sodium salt, a potassium salt, etc.) or a salt produced by reaction with a monovalent cationic group (e.g., $NH_4^{\oplus}$, etc.); and the amino group may form a salt by reacting with various kinds of acids, such as hydrochloric acid, sulfuric acid, nitric acid, phosphonic acid, oxalic acid, acetic acid, etc.

Examples of functional groups which are preferred substituent groups for A in formula (I) include hydroxyl groups, alkoxy groups, amino groups, ammonio groups, alkyl groups, mercapto groups, alkylthio groups, carbamoyl groups, sulfamoyl groups, and groups formed by substituting one of these groups with another (e.g., alkyl groups substituted with amino or ammonio groups, and alkylthio groups substituted with amino or ammonio groups). Among these groups, alkoxy, amino, ammonio, alkyl, mercapto, alkylthio, amino- or ammonio-substituted alkyl, and amino- or ammonio-substituted alkylthio groups are more preferred.

A preferred number of the members constituting the ring A is 5 or 6.

As for the compound of formula (I), one which contains not more than 30 carbon atoms, particularly not more than 20 carbon atoms, is preferred.

M in formula (I) represents a counter cation of a conjugate acid such as an alkali metal (e.g., sodium, potassium, etc.) or an organic base (e.g., triethylamine, pyridine, DBU (1,5-diazabicyclo[5,4,0]-7-undecene), etc.) or a hydrogen atom.

Specific examples of the compounds of the present invention, which are represented by formula (I), are illustrated below. However, the invention is not to be construed as being limited to the following examples.

I-(1)

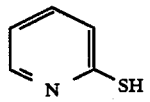

I-(2)

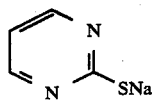

I-(3)

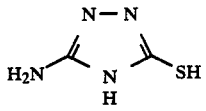

I-(4)

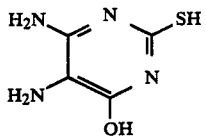

-continued

I-(5)

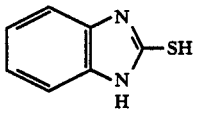

I-(6)

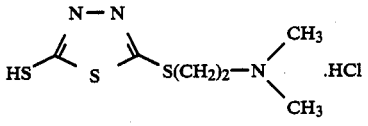

I-(7)

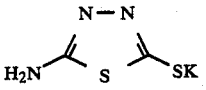

I-(8)

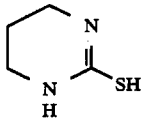

I-(9)

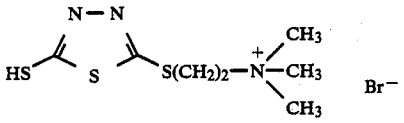

I-(10)

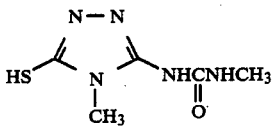

I-(11)

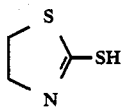

I-(12)

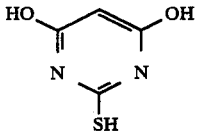

I-(13)

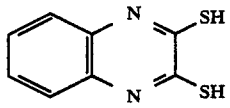

I-(14)

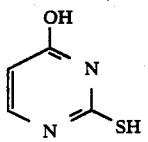

I-(15)

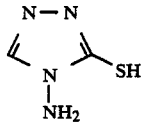

I-(16)

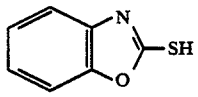

-continued

I-(17)

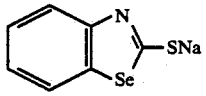

I-(18)

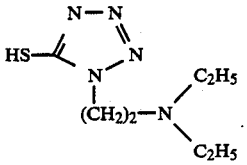

I-(19)

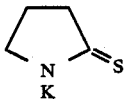

I-(20)

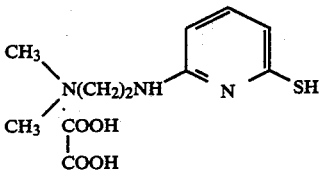

I-(21)

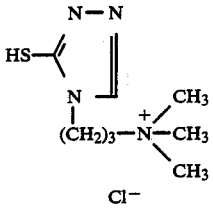

I-(22)

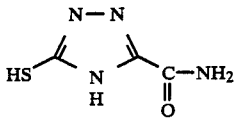

I-(23)

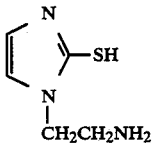

I-(24)

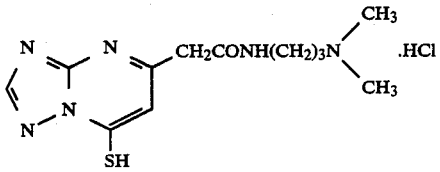

I-(25)

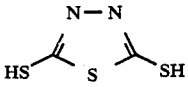

I-(26)

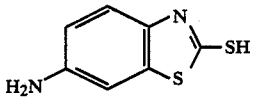

I-(27)

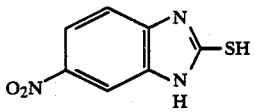

-continued

I-(28)

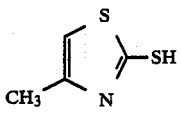

I-(29)

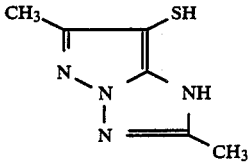

I-(30)

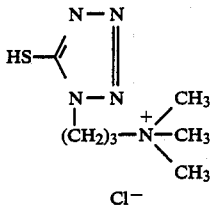

I-(31)

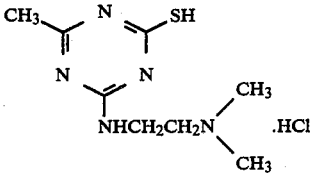

I-(32)

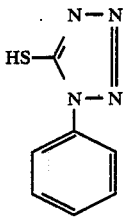

I-(33)

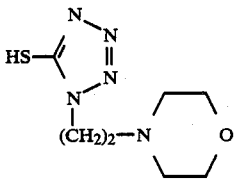

Among these compounds, Compounds I-(3), I-(5), I-(6), I-(7), I-(9), I-(10), I-(18), I-(21), I-(24), I-(30) and I-(33) are particularly preferred.

Many of the compounds represented by formula (I) are available as commercial products. Also, they can be synthesized with ease according to methods described in *Shin Jikken Kagaku Kohza* (*New Lectures on Experimental Chemistry*), Volume 14, Part III, pages 1699 to 1713, and Japanese Patent Application (OPI) No. 61749/85 (the term "OPI" as used herein refers to a "published unexamined Japanese patent application").

In addition, the compounds of formula (I) can be synthesized using methods described in the following publications.

U.S. Pat. Nos. 2,585,388 and 2,541,924, Japanese Patent Publication No. 21842/67, Japanese Patent Application (OPI) No. 50169/78, British Patent No. 1,275,701, D. A. Berges et al., *Journal of Heterocyclic Chemistry*, Vol. 15, p. 981 (1978), Klaus Hofmann, *The*

*Chemistry of Heterocyclic Compounds: Imidazole and Derivatives Part I*, pp. 336 to 339, 384 (Interscience Publishers, Inc., N.Y., 1953), *Chemical Abstract*, Vol. 58, No. 7921, p. 394 (1963), E. Hoggarth, *Journal of Chemical Society*, pp. 1160 to 1167 (1947), S. R. Saudler & W. Kars, *Organic Functional Group Preparation*, pp. 312 to 315 (Academic Press, 1968), M. Chamdon et al., *Bull. Chem. Fr.*, 723 (1954), D. A. Shirley & D. W. Alley, *J. Amer. Chem. Soc.*, Vol. 79, p. 4922 (1954), A. Wohl & W. Marchwald, *Berichte*, Vol. 22, p. 568 (1889), U.S. Pat. No. 3,017,270, British Patent No. 940,169, Japanese Patent Publication No. 8334/74, Japanese patent Application (OPI) No. 59463/80, *Advanced in Heterocyclic Chemistry*, Vol. 9, pp. 165 to 209 (1968), West German Patent 2,716,707, *Org. Synth.*, IV, p. 569 (1963), Japanese Patent Application (OPI) Nos. 89034/75, 28426/78, 21007/80, 202531/82 and 116340/82, and Japanese Patent Publication No. 28496/65.

The compounds represented by formula (I) include the compounds described in Japanese Patent Application (OPI) Nos. 114035/83, 201056/84, 83534/86 and 59952/87, and Japanese Patent Publication Nos. 33514/71 and 30857/72, which do not disclose sensitizing dyes or an acceleration effect upon elution of sensitizing dyes.

In formula (II), the alkylene group represented by $R_1$, $R_2$ and $R_3$ each contains 1 to 10, preferably 1 to 6, carbon atoms. Specifically, $-CH_2CH_2-$, $-(CH_2)_3-$, $-(CH_2)_4-$, $-(CH_2)_2-O-(CH_2)_2-$, and $-CH_2CH(OH)CH_2-$ can be cited as examples. As for the groups, other than hydrogen atom, represented by X and Y each, preferred groups include alkyl groups containing 1 to 10 carbon atoms (including substituted ones), e.g., methyl, ethyl, etc.; amino groups (including substituted ones), e.g., $-N(CH_3)_2$, $-N(C_2H_5)_2$, $-N(CH_2CH_2CN)_2$, $-N[CH_2CH(OH)CH_2OH]_2$, $-NH_2$, morpholino, etc.; ammonio groups (including substituted ones), e.g., trimethylammonio, etc.; aminocarbonyl groups (including substituted ones), e.g., dimethylaminocarbonyl, etc.; aminosulfonyl groups (including substituted ones), e.g., dimethylaminosulfonyl, etc. Of these groups, a hydrogen atom, an amino group and an ammonio group are more preferred. Preferably n is an integer of 1 to 4.

Further, the compounds represented by formula (II) may have the form of a salt produced by reacting with an inorganic or organic acid. Suitable examples of such inorganic and organic acids include hydrochloric acid, sulfuric acid, nitric acid, hydrobromic acid, hydroiodic acid, perchloric acid, oxalic acid, p-toluenesulfonic acid, methanesulfonic acid, trifluoromethanesulfonic acid and the like.

Specific examples of the compounds represented by formula (II) are illustrated below. However, the invention is not to be construed as being limited to these examples.

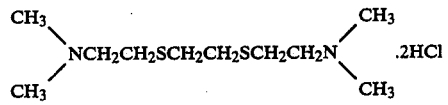
II-(1)

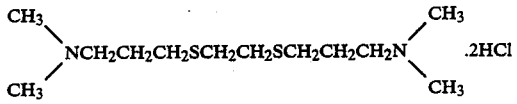
II-(2)

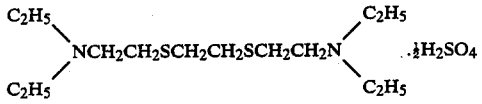
II-(3)

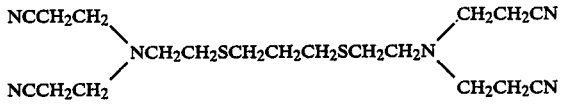
II-(4)

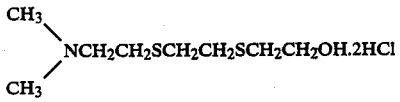
II-(5)

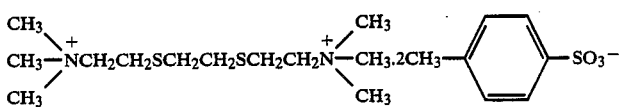
II-(6)

$H_2NCH_2CH_2SCH_2CH_2SCH_2CH_2NH_2$ II-(7)

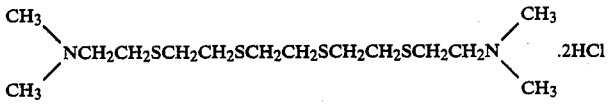
II-(8)

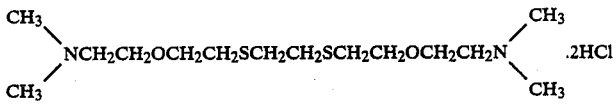
II-(9)

-continued $H_2NSO_2CH_2CH_2SCH_2CH_2SCH_2CH_2SO_2NH_2$ II-(10)

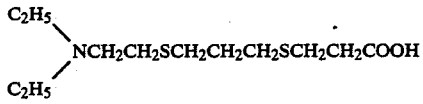
II-(11)

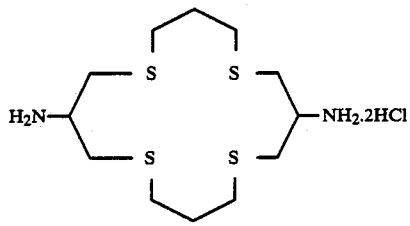
II-(12)

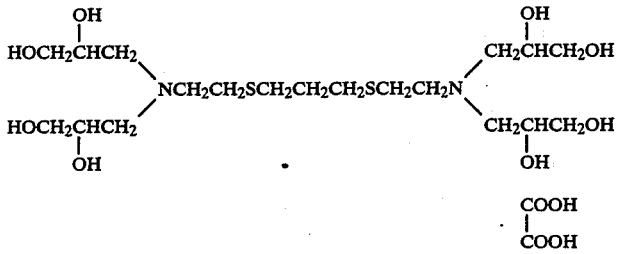
II-(13)

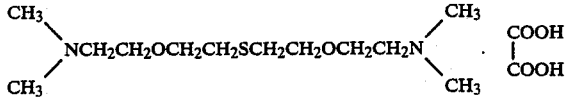
II-(14)

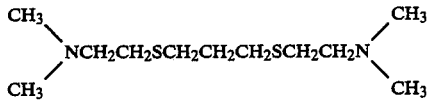
II-(15)

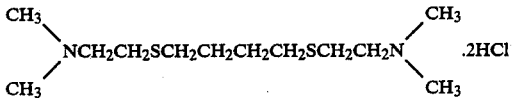
II-(16)

$CH_3OCH_2CH_2SCH_2CH_2CH_2SCH_2CH_2OCH_3$ II-(17)

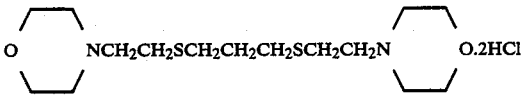
II-(18)

Among these compounds, Compounds II-(1), II-(2), II-(3), II-(4), II-(6), II-(7), II-(15) and II-(18) are particularly preferred.

The compounds represented by formula (II) can be synthesized using well-known methods. For syntheses of these compounds the methods described, e.g., in French Patent No. 1,108,788, U.S. Pat. Nos. 2,503,776, 2,912,329 and 3,021,215, British Patent No. 950,089, *Journal of The Organic Chemistry*, Vol. 26, pp. 1991 to 1995 (1961), and *Shin Jikken Kagaku Koza*, compiled by The Chemical Society of Japan, Vol. 14 (Syntheses and Reactions of Organic Compounds (III)), pp. 1713 to 1726, Maruzen (1978) can be referred to.

Organic thioether compounds as illustrated above are known to function as a silver halide solvent or a chemical sensitizer at the time of producing a silver halide photographic emulsion. For instance, methods of producing a monodispersed silver halide emulsion, which contains silver halide grains uniform in size, by including an organic thioether compound in a process of precipitating or physical ripening of silver halide grains at the time of producing a silver halide photographic emulsion, are disclosed, e.g., in U.S. Pat. Nos. 3,271,157, 3,531,289, 3,574,628 and 4,057,429.

Moreover, U.S. Pat. Nos. 2,521,926, 3,021,215, 3,038,805, 3,506,443, 3,057,724, 3,062,646, 3,574,709, 3,622,329 and 3,625,697 disclose methods of increasing the photographic speed of an emulsion by including an organic thioether in a chemical ripening process during the production of the emulsion or just before the emulsion coating.

In addition, U.S. Pat. No. 3,201,242, British Patent No. 1,020,032, German Patent No. 1,147,845, Belgian Patent No. 622,218, French Patent No. 1,351,410, Canadian Patent No. 766,184, Japanese Patent Application (OPI) Nos. 81644/84 and 63530/82 disclose methods of accelerating development by processing with a developer which contains an organic thioether.

However, these patents and publications do not disclose that an organic thioether compound of the above-described kind can be added to a fixer, washing water or a stabilizer to be used after development, and there is no disclosure that an organic thioether compound of the above-described kind can reduce color contamination with a sensitizing dye.

However, by the method of the present invention, a black-and-white silver halide photosensitive material sensitized spectrally with a sensitizing dye can be subjected to a rapid processing finished in less than about 90 seconds, particularly less than about 70 seconds, and what is more, the quantity of a replenisher for washing water or a stabilizer can be controlled to about 2 liters or less per square meter of the photosensitive material.

The photographic processing of an optically exposed silver halide photosensitive material in the present invention basically includes developing, fixing, washing and drying steps, or developing, fixing, stabilizing and drying steps. A stopping step may be carried out between the developing and fixing steps.

As for the developing agent contained in a developer to be used for the development processing of the present invention, combinations of dihydroxybenzenes and 1-phenyl-3-pyrazolidones are most preferred from the standpoint of facility in obtaining desirable developability. p-Aminophenol type developing agents also may be used.

Examples of dihydroxybenzene type developing agents which are preferably used in the present invention include hydroquinone, chlorohydroquinone, bromohydroquinone, isopropylhydroquinone, methylhydroquinone, 2,3-dichlorohydroquinone, 2,5-dichlorohydroquinone, 2,5-dibromohydroquinone, 2,5-dimethylhydroquinone and the like. Of these hydroquinones, hydroquinone is particularly preferred over others.

Examples of p-aminophenol type developing agents which can be used in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol and the like. Among these p-aminophenols, N-methyl-p-aminophenol is preferred.

Examples of 3-pyrazolidone type developing agents which are preferably used in the present invention include 1-phenyl-3-pyrazolidone, 1-phenyl-4,4-dimethyl-3-pyrazolidone, 1-phenyl-4-methyl-4-hydroxyphenyl-3-pyrazolidone, 1-phenyl-4,4-dihydroxyphenyl-3-pyrazolidone, 1-phenyl-5-methyl-3-pyrazolidone, 1-p-aminopenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone and the like.

The developing agent is generally used in an amount of about 0.01 to 1.2 mol/liter.

Suitable examples of sulfites used as a preservative in the development processing of the present invention include sodium sulfite, potassium sulfite, lithium sulfite, ammonium sulfite, sodium bisulfite, potassium metabisulfite, and so on. A sulfite is preferably used in an amount of about 0.2 mol/liter or more, particularly about 0.4 mol/liter or more. The upper limit of the amount of a sulfite to be added is preferably about 2.5 mol/liter.

The pH of a developer to be used in the development processing of the present invention is preferably adjusted to about 9 to 13, particularly about 10 to 12.

Suitable examples of alkali agents used for adjustment of a pH include sodium hydroxide, potassium hydroxide, sodium carbonate, potassium carbonate, sodium tertiary phosphate, potassium tertiary phosphate, and so on.

Buffering agents such as those described in Japanese Patent Application (OPI) No. 186259/87 (borates), those described in Japanese Patent Application (OPI) No. 93433/85 (e.g., saccharose, acetoxime, and 5-sulfosalicylic acid), phosphates, carbonates and so on may be used.

Further, a hardener may be used in the above-described developer. Preferably used hardeners include dialdehyde series or bisulfite adducts thereof, with specific examples including glutaraldehyde or the bisulfite adduct thereof, and so on.

Additives which may be used in addition to the above-described constituents include a development inhibitor such as sodium bromide, potassium bromide, potassium iodide, etc., an organic solvent such as ethylene glycol, diethylene glycol, triethylene glycol, dimethylformamide, methyl cellosolve, hexylene glycol, ethanol, methanol, etc., an antifoggant such as mercapto compounds (e.g., 1-phenyl-5-mercaptotetrazole, sodium 2-mercaptobenzimidazole-5-sulfonate, etc.), indazole compounds (e.g., 5-nitroindazole, etc.), benzotriazoles (e.g., 5-methylbenzotriazole, etc.), etc. Further, development accelerators described in *Research Disclosure*, Vol. 176, No. 17643, item XXXI (December, 1978), and optionally a toning agent, a surface active agent, a defoaming agent, a water softener, the amino compounds described in Japanese Patent Application (OPI) No. 106244/81, and so on may be contained in the developer.

In the development processing of the present invention, a silver stain inhibitor, such as the compounds described in Japanese patent Application (OPI) No. 24347/81, can be contained in the developer.

In the developer of the present invention, amino compounds, such as alkanolamines described in Japanese Patent Application (OPI) No. 10624/81, and so on, can be used.

In addition to the above-described additives, those described in L.F.A. Mason, *Photographic Processing Chemistry*, pp. 226 to 229 (Focal Press, 1966), U.S. Pat. Nos. 2,193,015 and 2,592,364, Japanese Patent Application (OPI) No. 64933/73, and so on may be used.

A fixer is an aqueous solution containing a thiosulfate as a fixing agent, and adjusted to a pH of about 3.8 or above, preferably about 4.2 to 7.0, and more preferably about 4.5 to 5.5.

As examples of a fixing agent, sodium thiosulfate, ammonium thiosulfate and so on can be cited. From the standpoint of a fixing speed, ammonium thiosulfate is particularly preferred over others. An amount of the fixing agent, though can be changed properly depending on the circumstances, generally ranges from about 0.1 to 6 mol/liter.

The fixer may contain a water-soluble aluminum salt to function as a hardener, with specific examples including aluminum chloride, aluminum sulfate, potassium alum, and so on.

The fixer can contain tartaric acid, citric acid, gluconic acid or a derivative thereof, independently or in combination of two or more thereof. These compounds can achieve their respective effects when they are used in an amount of about 0.005 mol or more, particularly about 0.01 to 0.03 mol, per liter of the fixer.

The fixer may contain preservatives (e.g., sulfites, bisulfites, etc.), pH buffering agents (e.g., acetic acid, boric acid, etc.), pH adjusting agents (e.g., sulfuric acid, etc.), chelating agents having a water-softening ability, and the compounds described in Japanese Patent Application (OPI) No. 78551/87, if desired.

In the photographic processing of the present invention, it is more desirable for rapid processing that the photosensitive material is designed so as to swell in a processing solution to a low degree (preferably ranging from about 150% to 50%), and thereby to weaken the hardening due to processing. More specifically, it is preferable to suppress hardening during development, and during fixation also. On the other hand, the hardening reaction may be depressed by adjusting the pH of the fixer to 4.6 or above. According to this procedure, replenishing kits for the developer and the fixer, respectively, can be made up of only one solution, which offers an advantage that each replenisher can be prepared by only diluting each replenishing kit with water.

In the photographic processing method of the present invention, a silver halide photosensitive material, which has received development processing, is processed with a fixer, washing water or a stabilizer, in one of which at least one compound represented by formula (I) or (II) is contained.

In this field of art, a stabilizer is often called "washing water", and a washing water is often called "stabilizer". Thus, these cannot be distinguished clearly.

The compounds of the present invention, which are represented by formula (I) or (II), are preferably added in an amount of about $5\times10^{-5}$ to $10^{-1}$ mol, particularly about $10^{-4}$ to $5\times10^{-2}$ mol, more particularly about $10^{-3}$ to $10^{-2}$ mol, per liter of fixer, washing water or stabilizer.

It is desired that washing water or stabilizer should be replenished in an amount of about 2 liters or less (including zero) per square meter of the photosensitive material processed.

Such a sharp reduction in replenishing amount can achieve a considerable saving on water, and further makes a pipe arrangement unnecessary in setting up an automatic developing machine. The replenisher may have the same composition as the mother solution which is firstly charged in the developing machine.

The method for replenishment and the continuous processing are described, e.g., in S. R. Goldwasser, *J. SMPTE.*, Vol. 62, 11 (1954).

As for the method of effecting a reduction in replenishing amount, a multistage countercurrent method (using two, three or more tanks) is conventionally used. If this method is applied to the present invention, the fixation-processed photosensitive material becomes cleaner and cleaner by being brought into contact with processing solutions in succession, from a processing solution contaminated with the fixer to one which is less contaminated with the fixer. Accordingly, washing can be performed with a much greater efficiency.

In order to effect water saving or no piping processing in the present photographic processing, it is preferred that mold proofing should be performed for the washing water or stabilizer.

Specific examples of mold proofing methods which can be adopted include the ultraviolet irradiation method described in Japanese Patent Application (OPI) No. 263939/85, the magnetic field application method described in Japanese Patent Application (OPI) No. 263940/85, the method of purifying water with ion exchange resins described in Japanese Patent Application (OPI) No. 131632/86, and the method of using the antimolds described in Japanese Patent Application (OPI) Nos. 115154/87, 153952/87, 220951/87 and 209532/87.

In addition, microbiocides, antimolds and surface active agents, as described in the article entitled "Water Quality Criteria" by L. E. West, published in *Photo. Sci. & Eng.*, Vol. 9, No. 6 (1965); the article entitled "Microbiological Growths in Motion Picture Processing" by M. W. Beach, published in *SMPTE Journal*, Vol. 85 (1976); the article entitled "Photo Processing Wash Water Biocides" by R. O. Deegan, published in *J. Imaging Tech.*, Vol. 10, No. 6 (1984); Japanese patent Application (OPI) Nos. 8542/82, 58143/82, 105145/83, 132146/82, 18631/83, 97530/82 and 157244/82; and so on, can be used together with the above-described mold proofing means.

The washing bath or the stabilizing bath of the present invention can additionally contain as microbiocides the isothiazoline compounds described in R. T. Kreiman, *J. Imaging Tech.*, Vol. 10, No. 6, p. 242 (1984), the isothiazoline compounds described in *Research Disclosure*, Vol. 205, No. 20526 (May, 1981), the isothiazoline compounds described in *Research Disclosure*, Vol. 228, No. 22845 (April, 1983), the compounds described in Japanese Patent Application No. 51396/86, and so on.

In addition, compounds as described in Hiroshi Horiguchi, *Bohkin Bohbai no Kagaku* (*Chemistry of Antibacteria and Antimolds*), (Sankyo Shuppan, 1982), and Nippon Bohkin Bohbai Gakkai, *Bohkin Bohbai Gijutsu Handbook* (*Handbook of Bacteria and Mold Proofing Techniques*), (Hakuhodo, 1986) may be contained in the washing water or the stabilizer to be used in the present invention.

Additionally, the washing water and the stabilizer may contain chelating agents such as aminopolycarboxylic acids and sulfonic acids described in Japanese Patent Application (OPI) No. 115154/87 as an antibacteria agent.

The washing water and the stabilizer may further contain surface active agents such as polyalkylene derivatives, amphoteric amino acids (including sulfobetaines), etc., so as to prevent squeeze unevenness and drying unevenness.

In washing with a small amount of water or stabilizing with a small amount of stabilizer in accordance with the present invention, it is preferred that a washing tank equipped with squeeze rollers as described in Japanese Patent Application (OPI) No. 18350/88 be used.

Furthermore, as described in Japanese Patent Application (OPI) No. 235133/85, a part or all of the solution overflowing the washing or stabilizing bath due to replenishment with water, in which a mold proofing means is introduced as illustrated above, depending on the processing conditions can be utilized as a fixing solution used prior to the washing or stabilization processing.

When the silver halide photosensitive material of the present invention is processed with an automatic developing machine (as described, e.g., in C. J. Kung et al., *Phot. Sci. Engng.*, February, 1959, p. 21 to 31) in which at least development, fixation, washing or stabilization, and drying steps are performed, it is preferred that the process from the beginning of development to the end of drying step should be completed within 90 seconds. More specifically, the period from the time at which the head of a photosensitive material begins to be dipped in a developer, through fixation and washing (or stabilization) steps, to the time at which the head of the same photosensitive material comes out from the drying zone after the drying is completed ("Dry to Dry" time) is preferably adjusted to about 90 seconds or less, more preferably about 70 seconds or less, and most preferably about 60 seconds or less.

The term "development processing time" or "development time" used in the present invention means the period from the time at which the head of a photosensitive material to be processed begins to be dipped in the developing tank installed in an automatic developing machine to the time at which the head of the photosensitive material begins to be dipped in the fixing bath; the term "fixation time" means a period from the time at which the head of the photosensitive material begins to be dipped in the fixing bath to the time at which the head of the photosensitive material begins to be dipped in the subsequent washing tank; and the term "washing time" means the period of time spent in dipping the photosensitive material in the washing bath.

In addition, the term "drying time" means the period of time in a drying zone in which a hot wind of about 35° to 100° C., preferably about 40° to 80° C., is blowing, which is installed in an automatic developing machine. The drying step may be carried out according to U.S. Pat. Nos. 3,545,971, 3,025,779, etc.

In order to achieve rapid processing in which the Dry to Dry time is within about 70 seconds, development time is controlled to about 20 seconds or less, preferably about 15 seconds or less, and a development temperature is fixed at about 25° to 50° C., preferably about 30° to 40° C.

According to the method of the present invention, fixation time is controlled to preferably about 6 to 20 seconds under a fixation temperature of about 20° to 50° C., more preferably about 6 to 15 seconds under a fixation temperature of about 30° to 40° C.

A washing or stabilization time is controlled to preferably about 6 to 20 seconds when a bath temperature is fixed at about 0° to 50° C., and more preferably about 6 to 15 seconds when a bath temperature is fixed at about 15° to 40° C.

In accordance with the method of the present invention, the photographic material which has received development, fixation, and washing or stabilization steps is preferably dried after washing water is thoroughly squeezed out from the photographic material, that is, the photographic material is passed between a pair of squeeze rollers. The drying is carried out at a temperature of about 40° to 100° C. A suitable drying time, though properly changed depending on the conditions, is generally from about 5 to 30 seconds, particularly preferably from about 5 to 20 seconds under a temperature of about 40° to 80° C.

In order to prevent the generation of developing unevenness, which is characteristic of rapid processing, in the photographic processing system of the present invention when Dry to Dry time is controlled to 70 seconds or less, it is preferred to use the method using rubber rollers attached to the outlet of a developing tank; the method of increasing a flow rate of the developer, which continues to be sent forth for the purpose of stirring, up to 10 m/min or above; or the method of stirring more vigorously during development than during standing-by. In order to effect rapid processing according to the present invention, it is desirable to further use opposing rollers as those to be installed in a fixing tank and to increase the fixing speed. By providing the fixing tank rollers with opposing rollers, reduction in the number of rollers becomes feasible, and in its turn, the processing tank can be made small in size. That is, an automatic developing machine can be rendered compact.

The photographic processing method of the present invention, though applicable to any kind of photographic material, is mainly used for general black-and-white photosensitive materials. Black-and-white photosensitive materials to which the method of the present invention is particularly preferably applicable include photographic materials of the kind which can provide medical images using a laser printer, scanner sensitive materials for graphic arts, direct X-ray sensitive materials for medical purposes, fluorographic sensitive materials for medical purposes, CRT image-recording sensitive materials, high contrast sensitive materials for graphic arts, and so on.

Photosensitive materials suitable for the rapid photographic processing in accordance with the above-described embodiments of the present invention can be produced using one of the following methods, or using two or more of the following methods in combination.

A first method involves using a silver halide having a low or no iodide content, more specifically, one which has an iodide content of 0 to 5 mol %, with examples including silver chloride, silver bromide, silver chlorobromide, silver iodobromide, silver chloroiodobromide and the like.

A second method involves incorporating a water-soluble iridium salt into a silver halide emulsion.

A third method involves coating a silver halide emulsion at a reduced silver coverage. More specifically, the silver coverage per one side is controlled to about 1 to 3.5 g/m$^2$, preferably about 1 to 3 g/m$^2$, and more preferably about 1 to 2.2 g/m$^2$.

A fourth method involves forming an emulsion under such conditions as to diminish the average size of silver halide grains constituting the emulsion. More specifically, the average size of silver halide grains is controlled to about 1.0 m or less, preferably about 0.7 m or less.

A fifth method involves using tabular grains, e.g., those having an aspect ratio of about 4 or above, preferably about 5 or above, as silver halide grains to constitute an emulsion.

A sixth method involves designing a silver halide photosensitive material so as to have a swelling degree of about 200% or less.

Silver halide grains in a photographic emulsion may be regular grains having a regular crystal form, such as that of a cube, octahedron, tetradecahedron or the like; those having an irregular crystal form, e.g., a spherical form; those having crystal defects, e.g., a twinning plane; tabular grains, or a composite form of two or more thereof.

The aspect ratio of tabular grains is defined as the ratio of an average of diameters of circles having the same areas as individual projected areas of the grains to an average of individual thicknesses of tabular grains. Tabular grains to be used in the present invention preferably have an aspect ratio ranging from about 4 to less than 20, particularly from about 5 to less than 10, and what is more, a grain thickness of about 0.3 m or less, particularly about 0.2 m or less.

It is preferred that tabular grains make up at least about 80 wt %, particularly at least about 90 wt %, of the whole grains.

The size distribution of the silver halide grains may be narrow as that of a monodispersed emulsion, or as broad as that of a polydispersed emulsion.

Silver halide photographic emulsions which can be used in the present invention can be prepared according to known methods, for instance, those described in *Research Disclosure,* No. 17643, pp. 22 and 23 (December, 1978), entitled "I. Emulsion preparation and types", and *Research Disclosure,* No. 18716, p. 648 (November, 1979).

Also, photographic emulsions to be used in the present invention can be prepared using methods as described in P. Glafkides, *Chimie et Physique Photographique,* (Paul Montel, 1967), G. F. Duffin, *Photographic Emulsion Chemistry,* (Focal Press, 1966), V. L. Zelikman et al., *Making and Coating Photographic Emulsion,* (Focal Press, 1964).

In order to control the crystal growth of silver halide grains, silver halide solvents, such as ammonia, potassium thiocyanate, ammonium thiocyanate, thioether compounds (e.g., those described in U.S. Pat. Nos. 3,271,157, 3,574,628, 3,704,130, 4,297,439 and 4,276,374), thione compounds (e.g., those described in Japanese Patent Application (OPI) Nos. 144319/78, 82408/78 and 77737/80), amine compounds (e.g., those described in Japanese Patent Application (OPI) No. 100717/79), and so on can be used in forming silver halide grains to be used in the present invention.

Water-soluble rhodium salts and water-soluble iridium salts as described above can be used in preparing these silver halide emulsions.

Suitable methods for reacting a water-soluble silver salt with a water-soluble halide include, e.g., a single jet method, a double jet method, or a combination thereof.

Also, a method in which silver halide grains are produced in the presence of excess silver ion (the "reverse mixing" method) can be employed. On the other hand, the "controlled double jet" method, in which the pAg of the liquid phase in which silver halide grains are to be precipitated is maintained constant, may be also employed. According to this method, a silver halide emulsion is obtained having a regular crystal form and grain sizes nearly uniform.

It is preferred that silver halide emulsions to be used in the method of the present invention should be chemically sensitized.

For the chemical sensitization, conventional sulfur sensitization, reduction sensitization, noble metal sensitization, and a combination of two or more thereof can be employed.

As examples of chemical sensitizers, mention may be made of sulfur sensitizers including allylthiocarbamide, thiourea, thiosulfates, thioethers, cystine and the like; noble metal sensitizers including potassium chloroaurate, aurous thiosulfate, potassium chloropalladate, etc.; and reduction sensitizers including stannous chloride, phenylhydrazine, reductone, etc.

Silver halide emulsions to be used in the present invention are spectrally sensitized with known spectral sensitizing dyes. Examples of usable spectral sensitizing dyes include cyanine dyes, merocyanine dyes, rhodacyanine dyes, styryl dyes, hemicyanine dyes, oxonol dyes, benzilidene dyes, holopolar dyes and so on, as described in F. M. Hamer, *Heterocyclic Compounds, The Cyanine Dyes and Related Compounds,* (John Wiley & Sons, 1964), D. M. Sturmer, *Heterocyclic Compounds, Special Topics in Heterocyclic Chemistry,* (John Wiley & Sons, 1977). Of these dyes, cyanine and merocyanine dyes are particularly preferred.

Sensitizing dyes which can be preferably used in the present invention include cyanine dyes and merocyanine dyes represented by the general formulae as illustrated in Japanese Patent Application (OPI) Nos. 133442/85, 75339/86, 6251/87, 212827/84, 122928/75 and 1801553/84. More specifically, sensitizing dyes which can spectrally sensitize silver halides in a blue, green, red or infrared portion of the spectrum, as described in Japanese Patent Application (OPI) No. 133442/85, pp. 8–11, Japanese Patent Application (OPI) No. 75339/86, pp. 5–7 and pp. 24–25, Japanese Patent Application (OPI) No. 6251/87, pp. 10-15, Japanese Patent Application (OPI) No. 212827/84, pp. 5–7, Japanese Patent Application (OPI) No. 122928/75, pp. 7–9, Japanese Patent Application (OPI) No. 180553/84, pp. 7–18.

These sensitizing dyes may be employed individually or in combination. Combinations of sensitizing dyes are often employed for the purpose of supersensitization. Materials which can exhibit a supersensitizing effect in combination with a certain sensitizing dye although they themselves do not spectrally sensitize silver halide emulsions or do not absorb light in the visible region may be incorporated into the silver halide emulsions. For example, aminostilbene compounds substituted with nitrogen-containing heterocyclic groups (e.g., as described in U.S. Pat. Nos. 2,933,390 and 3,635,721), aromatic organic acid-formaldehyde condensates (e.g., as described in U.S. Pat. No. 3,743,510), cadmium salts, azaindene compounds, and so on can be used. Particularly useful combinations are disclosed in U.S. Pat. Nos. 3,615,613, 3,615,641, 3,617,295 and 3,635,721.

The above-described sensitizing dyes are incorporated in a silver halide photographic emulsion in an amount of about $5\times10^{-7}$ to $5\times10^{-2}$ mol, preferably about $1\times10^{-6}$ to $1\times10^{-3}$ mol, particularly preferably about $2\times10^{-6}$ to $5\times10^{-4}$ mol, per mol of silver halide.

The foregoing sensitizing dyes can be dispersed directly into an emulsion. Also, they can first be dissolved in a proper solvent, e.g., methyl alcohol, ethyl alcohol, methyl cellosolve, acetone, water, pyridine or a mixture of two or more thereof, and then added to an emulsion in the form of a solution. In dissolving sensitizing dyes in a proper solvent, ultrasonic waves can be used. Further examples of processes which can be employed for adding the foregoing sensitizing dyes to emulsions include a process of dissolving a dye in a volatile organic solvent, dispersing the solution into a hydrophilic colloid, and adding this dispersion to an emulsion, as described in U.S. Pat. No. 3,469,987; a process of dispersing a water-insoluble dye into a water-soluble solvent in an undissolved condition, and adding the resulting dispersion to an emulsion, as described in Japanese Patent Publication No. 24185/71; a process of mechanically grinding a water-insoluble dye into fine particles in an aqueous solvent to disperse the dye into the solvent, and adding the resulting dispersion to an emulsion, as described in Japanese Patent Publication No. 45217/86; a process of dissolving a dye into a surface active agent, and adding the resulting solution to an emulsion, as described in U.S. Pat. No. 3,822,135; a process of dissolving a dye by utilizing a red shift compound, and adding the resulting solution to an emulsion, as described in Japanese Patent Application (OPI) No. 74624/76; a process of dissolving a dye into a substantially water-free acid, and adding the resulting solution to an emulsion, as described in Japanese Patent Application (OPI) No. 80826/75; and so on. Furthermore, methods as described in U.S. Pat. Nos. 2,912,343, 3,342,605, 2,996,287 and 3,429,835 can be used for addition of sensitizing dyes to emulsions. Homogeneous dispersion of the foregoing sensitizing dyes into silver halide emulsions may be carried out at time so long as it is done before coating on a proper support. Namely, the dispersion can be performed at any stage of the emulsion making.

Moreover, the foregoing sensitizing dyes can be used in combination with other sensitizing dyes as described in U.S. Pat. Nos. 3,703,377, 2,688,545, 3,397,060, 3,615,635 and 3,628,964, British Patents Nos. 1,242,588 and 1,293,862, Japanese Patent Publication Nos. 4936/68, 14030/69 and 10773/68, U.S. Pat. No. 3,416,927, Japanese Patent Publication No. 4930/68, U.S. Pat. Nos. 2,615,613, 3,615,632, 3,617,295 and 3,635,721.

In order to effect rapid processing, it is preferred that the silver halide photosensitive material should have a swelling degree of about 200% or less.

However, it is undesirable to lower the swelling degree beyond necessity, because when the swelling degree is rendered too low, rates of development, fixation, washing and so on are decreased.

Preferred swelling degrees are within the range of from not more than about 200% to not less than about 30%, particularly from not more than about 150% to not less than about 50%.

Controlling the swelling degree to not more than 200% be achieved with ease by those of ordinary skill in the art, e.g., by increasing the amount of a hardener used in the photosensitive material.

The swelling degree can be determined by the following process.

That is, the process involves (a) subjecting a photographic material to be examined to incubation processing for 3 days at 38° C. and 50% RH, (b) measuring the thickness of the hydrophilic colloid layer, (c) soaking the resulting photographic material in distilled water at 21° C. for 3 minutes, and (d) measuring the thickness of the resulting hydrophilic colloid layer, comparing this thickness with the thickness measured in step (b) and expressing a change in thickness as a percentage.

As examples of hardeners which can be used in the present invention, organic compounds such as aldehyde series compounds, active halogen-containing compounds as described in U.S. Pat. No. 3,288,775, compounds containing a reactive ethylenic unsaturated group as described in U.S. Pat. No. 3,635,718, epoxy compounds as described in U.S. Pat. No. 3,091,537, and halogenocarboxyaldehydes such as mucochloric acid are known. Among these hardeners, vinylsulfone type hardeners are preferred. In addition, polymeric hardeners can preferably be used.

As for the polymeric hardeners, polymers containing active vinyl groups or precursors thereof are preferred. Of such polymers, those having a main chain to which active vinyl groups or precursor groups thereof are attached through long spacers are particularly preferred over others. The amount of these hardeners added in order to attain such a swelling degree as described above varies depending on the kind of the hardener used and the type of gelatin used.

In the rapid processing of the present invention, it is preferred that an organic substance capable of causing elution during development processing should be contained in an emulsion layer or other hydrophilic colloid layers. When the organic substance to be eluted is gelatin, gelatins that do not take part in the cross-linking reaction of gelatin by a hardener are preferred. For instance, acetylated gelatins and phthaloylated gelatins are typical of the foregoing gelatin types, and those having rather low molecular weights are preferred. As for the macromolecular substances other than gelatin, hydrophilic polymers such as polyacrylamides as described in U.S. Pat. No. 3,271,158, polyvinyl alcohol, polyvinyl pyrrolidone and the like can be effectively used. Further, sugars such as dextran, saccharose, pluran, etc., are also effective. Of these macromolecular substances, polyacrylamides and dextran, especially polyacrylamides, are preferred over others. Perferred means molecular weights of these substances are about 20,000 or less, particularly about 10,000 or less. In addition to the foregoing organic substances, anti-foggants and stabilizers described in *Research Disclosure,* Vol. 176, No. 17643, Item VI (December, 1978) can be used.

The photographic processing method of the present invention can be applied to the image formation processing of silver halide photosensitive materials which can acquire photographic characteristics of ultrahigh contrast and high sensitivity by using hydrazine derivatives, as described in U.S. Pat. Nos. 4,224,401, 4,168,977, 4,166,742, 4,311,781, 4,272,606, 4,221,857 and 4,243,739.

As for the hydrazine derivatives, those described in *Research Disclosure,* No. 23516, p. 346 (December, 1983), the publications cited therein, U.S. Pat. Nos. 4,080,207, 4,269,929, 4,276,364, 4,278,748, 4,385,108, 4,459,347, 4,560,638 and 4,478,928, British Patent No. 2,011,391B, and Japanese Patent Application (OPI) No. 179734/85 can be used. Such a hydrazine derivative as described above is preferably added in an amount of about $1\times10^{-6}$ to $5\times10^{-2}$ mol, particularly about $1\times10^{-5}$ to $2\times10^{-2}$ mol, per mol of silver halide. In a developer to be used in this case, it is preferred that amino compounds described in U.S. Pat. No. 4,269,929 be used as an accelerator for increasing the contrast.

The present invention will now be illustrated in greater detail by reference to the following examples, but the invention is not to be construed as being limited to these examples. Unless otherwise indicated, all parts, percents and ratios are by weight.

EXAMPLE 1 Preparation of Emulsion

30 g of gelatin and 6 g of potassium bromide were added to 1 liter of water placed in a vessel maintained at 60° C. Thereto, a water solution of silver nitrate (in which 5 g of silver nitrate was contained) and a water solution of potassium bromide in which 0.15 g of potassium iodide was contained were added over a 1 minute period with stirring in accordance with a double jet method. Thereafter, a water solution of silver nitrate (in which 145 g of silver nitrate was contained) and a water solution of potassium bromide in which 4.2 g of potassium iodide was contained were further added using the double jet method. The rate of flow of each solution added was increased so that the flow rate at the conclusion of addition was 5 times the flow rate at the beginning of addition. After the conclusion of addition, soluble salts were removed at 35° C. using a flocculation method. Then, the resulting emulsion was heated to 40° C., and thereto was supplementally added 75 g of gelatin, followed by adjustment of the pH to 6.7. The thus-obtained emulsion grains were tabular in shape, and had a diameter of 0.98 μm on a basis of projected area, an average thickness of 0.138 μm, and an iodide content of 3 mol %. Subsequently, the resulting emulsion was chemically sensitized with a combination of gold and sulfur sensitizers.

Production of Photographic Material 101

For forming a surface protecting layer, an aqueous gelatin solution containing, in addition to gelatin, polyarylamide having a mean molecular weight of 8,000, sodium polystyrenesulfonate, polymethyl methacrylate fine particles (average particle size: 3.0 μm), polyethylene oxide, and a hardener was employed.

To the foregoing emulsion, a sodium salt of anhydro-5,5'-dichloro-9-ethyl-3,3'-di(3-sulfopropyl)-oxacarbocyanine hydroxide as a sensitizing dye, and potassium iodide were added in amounts of 500 mg and 200 mg, respectively, per mol of silver. Thereto were further added a mixture of 4-hydroxy-6-methyl-1,3,3a,7-tetraazaindene and 2,6-bis(hydroxyamino)-4-diethylamino-1,3,5-triazine as a stabilizer, trimethylolpropane as a drying mark inhibitor, a coating aid and a hardener to prepare a coating composition.

The gelatin solution for a surface protecting layer and the foregoing coating composition for an emulsion layer were coated on both sides of a polyethylene terephthalate film by a simultaneous coating method, and dried to produce the photographic material 101. Therein, silver coverage on each side was controlled to 2 g/m$^2$. The swelling degree as defined above was 120%.

The thus-obtained photographic material was exposed to X-rays, and subjected to a photographic processing with a developer, a fixer and washing water prepared according to the following formulae, respectively.

Concentrated Liquid Developer

| | |
|---|---|
| Potassium Hydroxide | 60 g |
| Sodium Sulfite | 100 g |
| Potassium Sulfite | 125 g |
| Diethylenetriaminepentaacetic Acid | 6 g |
| Boric Acid | 25 g |
| Hydroquinone | 87.5 g |
| Diethylene Glycol | 28 g |
| 4-Hydroxymethyl-4-methyl-1-phenyl-3-pyrazolidone | 6.25 g |
| 5-Methylbenzotriazole | 0.15 g |
| Water to make | 1 l |

It was adjusted to pH 11.00. The replenisher kit size was 5 l.

Concentrated Liquid Fixer

| | |
|---|---|
| Ammonium Thiosulfate | 560 g |
| Sodium Sulfite | 60 g |
| Disodium Ethylenediaminetetraacetate Dihydrate | 0.10 g |
| Sodium Hydroxide | 24 g |
| Water to make | 1 l |

It was adjusted to pH 5.10 with acetic acid. The replenisher kit size was 5 l.

Solution for Water Stock Tank

| | |
|---|---|
| Disodium Ethylenediaminetetraacetate Dihydrate (antimold) | 0.5 g/l |

-continued

| Compound of the Invention | Refer to Table 1 |
|---|---|
| The pH was adjusted to 5.2. | |

In the photographic processing, an automatic developing machine (See FIG. 1) was used, and the Dry to Dry time was controlled to 55 seconds.

In the automatic developing machine, the developing tank (1) had a volume of 7.5 liters, was kept at 35° C. and equipped with opposing rollers, and the development time was 11.5 seconds; the fixing tank (2) had a volume of 7.5 liters, was kept at 35° C. and equipped with opposing rollers, and the fixation time was 12.5 seconds; the washing tank (3) had a volume of 6 liters, was kept at 20° C. and equipped with opposing rollers, and washing time was 7.5 seconds; the squeeze roller cleaning through (7) had a volume of 200 ml; the water stock tank (4) had a volume of 25 liters, and drying was carried out at 50° C. for 17.5 seconds.

Therein, a heater was used for maintaining the developing and the fixing tanks at the same temperature, but cooling water was not used.

In starting the photographic processing, each tank was filled with the following processing solution Developing Tank (1)

400 ml portion of the foregoing concentrated liquid developer, 600 ml of water and 10 ml of an aqueous solution containing 2 g of potassium bromide and 1.8 g of acetic acid were placed therein The pH of the resulting developer was 10.50.

Fixing Tank (2)

250 ml portion of the foregoing concentrated liquid fixer and 750 ml of water were placed therein.

Washing Tank (3) and Cleaning Trough (7)

The same solution as the foregoing solution for the water stock tank was placed therein.

The following quantities of processing solutions were replenished in their respective tanks for each photographic processing of one sheet of the above-described photographic material having a quarto size (10 inches×12 inches). Namely, as shown in the schematic diagram of an automatic developing machine (FIG. 1), 20 ml of the concentrated liquid developer and 30 ml of the solution for water stock tank were replenished into the developing tank; 10 ml of the concentrated liquid fixer and 30 ml portion of the overflow from the washing tank were replenished into the fixing tank; and 60 ml of the solution for the water stock tank was replenished into the washing tank from the squeeze roller cleaning trough. A running processing in which 50 sheets of the quarto-size photographic material (the percentage of developed area in one sheet of film was 40%) a day were processed one after another was continued for 1 week. When the developer, the fixer and washing water were exhausted during the running processing, they were replenished with new ones, respectively.

A flow rate of the developer agitated by circulation was 20 l/min under development processing, while it was 6 l/min under the condition of standby.

At the conclusion of one day's processing work, the rollers for crossing-over between development and fixation, and between fixation and washing were cleaned by intermittently and automatically spraying the washing water reservoired in the water stock tank in an amount of 80 ml from 10 orifices onto each roller (as described in Japanese Patent Application (OPI) No. 287252/87).

The Dry to Dry processing time was fixed at 55 seconds as described above.

Color contaminations remaining after the photographic processings for 1 week (determined from the transmission optical density of the nonimage area measured with green light) were shown in Table 1.

TABLE 1

| Test No. | Present Compound Added in Washing | Amount Added (g/l) | Color Contamination after Processing | Note |
|---|---|---|---|---|
| 1 | Not Added | — | 0.209 | |
| 2 | Compound I-(6) | 1.5 | 0.140 | |
| 3 | Compound I-(9) | 1.8 | 0.143 | |
| 4 | Compound I-(18) | 1.0 | 0.144 | |
| 5 | Compound I-(21) | 1.4 | 0.146 | |
| 6 | Compound I-(30) | 1.5 | 0.138 | |
| 7 | Compound I-(32) | 0.5 | 0.141 | |
| 8 | Every processing time in Test 1 was doubled, and thereby Dry to Dry time was fixed at 110 sec. | — | 0.139 | When processing times were increased, color contamination was not caused. |
| 9 | The replenishing amount of washing water in Test 1 was changed to 250 ml per one sheet of quarto-size film | — | 0.202 | Even when washing water was replenished in an increased amount, color contamination was not diminished. |
| 10 | The replenishing amount of washing water in Test 2 was changed to 250 ml per one sheet of quarto-size film | 1.5 (I-(6)) | 0.139 | Maintaining the concentration of the present compound in washing water at the prescribed value was disadvantageous from an economical point of view. |

As can be seen from the data in Table 1, using the washing water containing the compound of the present invention considerably reduced color contamination remaining after photographic processing even when the processing was carried out very rapidly, and using reduced amounts of replenishers.

EXAMPLE 2

Photographic materials 201 to 203 were produced in the same manner as in Example 1, except different sensitizing dyes as illustrated below were employed respectively, and processed with the same automatic developing machine in the same manner as in Example 1.

| Sample No. | Sensitizing Dye (amount added: g/mol Ag) | Compound Added to Washing Water (amount added: g/l) | (Color Contamination Density without Present Compound) Minus (Color Contamination Density with Present Compound) |
|---|---|---|---|
| 201 | A (500) | I-(6) (1.6) | 0.053 |
| 202 | B (500) | I-(6) (1.5) | 0.049 |
| 203 | C (400) | I-(18) (1.0) | 0.050 |

In every sample, color contamination was diminished by processing with the washing water containing the compound of the present invention.

Sensitizing Dye (A)

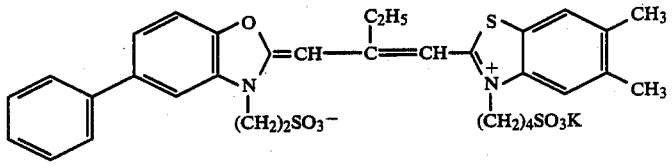

Sensitizing Dye (B)

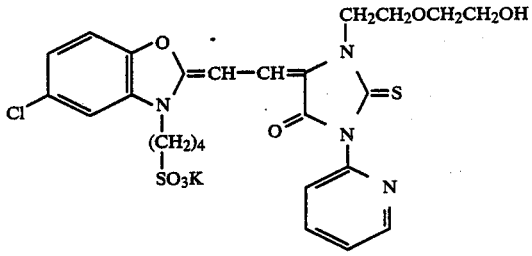

Sensitizing Dye (C)

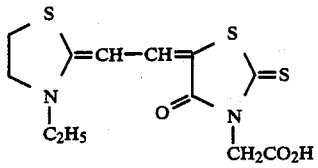

EXAMPLE 3

To an emulsion containing cubic silver iodobromide grains having an iodide content of 2.5 mol % and a mean grain size of 0.3 μm were added 230 mg/mol Ag of sodium anhydro-5,5-dichloro-9-ethyl-3,3'-bis(3-sulfopropyl)oxacarbocyanine hydroxide (sensitizing dye), 1.3 g/mol Ag of a hydrazine derivative (illustrated below) and 300 mg/mol Ag of polyethylene glycol (having a molecular weight of about 1,000). Thereto, 5-methylbenzotriazole, 4-hydroxy-6-methyl-1,3,3a,7-tetraazaindene, a dispersion of polyethyl methacrylate and a sodium salt of 2-hydroxy-1,3,5-triazine were further added. Moreover, 1,3-divinylsulfonyl-2-propanol was added as a hardener in such an amount as to impart a swelling degree of 120% to the resulting emulsion.

The thus-prepared coating composition was coated on a polyethylene terephthalate film simultaneously with coating of a protective layer in such an amount that the resulting film had a silver coverage of 3.5 g/m$^2$ and a gelatin coverage (as combination of the emulsion layer and the protective layer) of 3.0 g/m$^2$, resulting in the formation of a photosensitive film.

Hydrazine Derivative

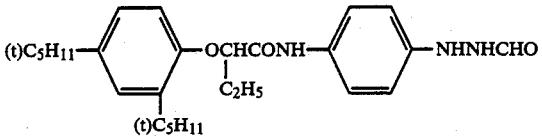

After exposure to light through an optical wedge for sensitometry which was equipped with a 150-line magenta contact screen, the film was developed for 15 seconds at 40° C. with a developer having the following composition, and then fixed with Fixer GR-F1 made by Fuji Photo Film Co., Ltd., followed by washing and subsequent drying steps. In the automatic developing machine used herein, the Dry to Dry time was fixed at 65 seconds.

Composition of Developer

| | |
|---|---|
| Tetrasodium Ethylenediaminetetraacetate | 1.0 g |
| Sodium Hydroxide | 9.0 g |
| 5-Sulfosalicylic Acid | 44.0 g |
| Potassium Sulfite | 100.0 g |
| 5-Methylbenzotriazole | 0.5 g |
| N-Butyl Diethanolamine | 15.0 g |
| Potassium Bromide | 6.0 g |
| N-Methyl-p-aminophenyl.$\frac{1}{2}H_2SO_4$ | 0.4 g |
| Hydroquinone | 54.0 g |
| Sodium p-Toluenesulfonate | 30.0 g |
| Water to make | 1 l |
| pH to be adjusted to | 11.7 |

The same water solution as used in Test 1 of Example 1 was employed as washing water, and replenished in an amount of 250 ml per one sheet of the full-size film (20 inches×24 inches).

Separately, the processing was carried out using the solution obtained by adding 1.5 g/l of Compound I-(6) according to the present invention to the foregoing washing water. Color contamination remaining after processing in each case was examined in the same manner as in Example 1. The color contamination density was decreased by 0.045 by virtue of using washing water containing the compound of the present invention in the photographic processing.

EXAMPLE 4

To a water solution of gelatin kept at 50° C., $4\times10^{-7}$ mol/mol Ag of iridium (III) hexachloride was added, and subsequently a water solution of silver nitrate, a water solution of potassium bromide and a water solution of potassium iodide were simultaneously added in the presence of ammonia over a 60 minute period as the pAg of the reaction system was kept at 7.8. Thus, a monodispersed emulsion containing silver iodobromide grains having a mean grain size of 0.25 μm and an average iodide content of 1 mol % was prepared. To the silver iodobromide emulsion, the compound described below was added as a sensitizing dye in an amount of $5.6\times10^{-5}$ mol/mol Ag, and further 4-hydroxy-6-methyl-1,3,3a,7-tetraazaindene (as a stabilizing agent), a dispersion of polyethylene glycol, 1,3-vinylsulfonyl-2-propanol, 1-phenyl-5-mercaptotetrazole and 1,4-bis[3-(4-acetylaminopyridinio)propionyloxy]tetramethylenedipromide, and the same hydrazine derivative as used in Example 3 (in an amount of $4.8\times10^{-3}$ mol/mol Ag) were added. Then, the pH of the emulsion was adjusted with ascorbic acid so that the pH was 5.5 at the surface of the emulsion coat (the pH of the film surface was measured according to the method described in Japanese Patent Application (OPI) No. 25745/87), and the resulting emulsion was coated on a polyethylene terephthalate film at a silver coverage of 3.4 g/m$^2$. Simultaneously with the coating of the emulsion, a gelatin layer was formed on the emulsion layer at a gelatin coverage of 1.0 g/m$^2$. The thus-produced sample was exposed to light, subjected to photographic processing, and examined for photographic characteristics.

Sensitizing Dye

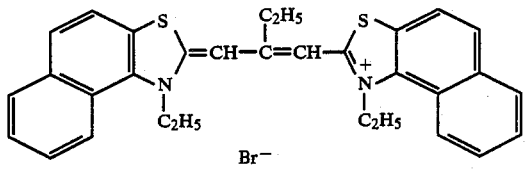

Formula of Developer

| | |
|---|---|
| Hydroquinone | 35.0 g |
| N-Methyl-p-aminophenol.$\frac{1}{2}$Sulfate | 0.8 g |
| Sodium Hydroxide | 13.0 g |
| Potassium Tertiary Phosphate | 74.0 g |
| Potassium Sulfite | 90.0 g |
| Tetrasodium Ethylenediaminetetraacetate Dihydrate | 1.0 g |
| Potassium Bromide | 4.0 g |
| 5-Methylbenzotriazole | 0.6 g |
| 3-Diethylamino-1,2-propanediol | 15.0 g |
| Water to make | 1 l |
| pH | 11.5 |

Formula of Fixer

| | |
|---|---|
| Ammonium Thiosulfate | 150 g |
| Sodium Sulfite | 30 g |
| Acetic Acid | 30 g |
| Water to make | 1 l |

The pH of the fixer was adjusted to 5.00 using NaOH.

The photographic processing was carried out under the following conditions:

Development: 40° C., 15 sec.
Fixation: 37° C., 16 sec.
Washing: 12 sec.
Dry to Dry: 67 sec.

The sample processed in the above-described manner showed excellent photographic properties (including $D_{max}$, sensitivity, gamma value, and prevention of black spots), and what is more, color contamination was lowered by 0.027 with respect to red color density.

EXAMPLE 5

Another experiment was carried out in the same manner as in Example 1, except the fixer and washing water were replaced by the following solutions.

Concentrated Liquid Fixer

| | |
|---|---|
| Ammonium Thiosulfate | 560 g |
| Sodium Sulfite | 60 g |
| Disodium Ethylenediaminetetraacetate Dihydrate | 0.10 g |
| Sodium Hydroxide | 24 g |
| Compound of the Invention | (Refer to Table 2) |
| Water to make | 1 l |

The pH of the fixer was adjusted to pH 5.10 using acetic acid. The replenisher kit size was 5 liters.

Solution for Water Stock Tank

| | |
|---|---|
| Disodium Ethylenediaminetetraacetate Dihydrate (antimold) | 0.5 g/l |

Table 2 shows color contamination observed after the conclusion of the photographic processing (which was examined by measuring an optical transmission density of the nonimage area with green light).

TABLE 2

| Present Compound Added to Fixer | Amount Added (g/l) | Color Contamination after Processing (optical transmission density) |
|---|---|---|
| Control | — | 0.209 |
| Compound I-(6) | 1.5 | 0.166 |
| Compound I-(9) | 1.8 | 0.165 |
| Compound I-(18) | 1.0 | 0.162 |
| Compound I-(21) | 1.4 | 0.159 |
| Compound I-(30) | 1.5 | 0.157 |
| Compound I-(32) | 0.5 | 0.161 |

As is seen from Table 2, all of the fixers containing the compounds of the present invention reduced color contamination remaining after photographic processing.

EXAMPLE 6

The same photographic materials as produced in Example 2, i.e., Samples 601 to 603, were processed using the automatic developing machine under the same conditions as in Example 5.

| Sample No. | Sensitizing Dye (amount added: g/mol Ag) | Compound Added to Fixer (amount added: g/l) | (Color Contamination Density without Present Compound) Minus (Color Contamination Density with Present Compound) |
|---|---|---|---|
| 601 | A (500) | I-(6) (1.5) | 0.058 |
| 602 | B (500) | I-(18) (1.0) | 0.049 |
| 603 | C (400) | I-(6) (1.5) | 0.052 |

When processed with the fixer containing the compound of the present invention, every sample had reduced color contamination.

EXAMPLE 7

Photographic processing was performed using the fixer prepared by adding one of the present compounds, I-(6), to Fixer GR-F1, which was employed in Example 3, in an amount of 1.0 g/l, and washing water to which none of the present compounds was added, and color contamination remaining after photographic processing was examined in the same manner as in Example 1. The density of color contamination remaining after this photographic processing was lower by 0.045 than that remaining after photographic processing in which none of the present compounds was used.

EXAMPLE 8

An experiment was carried out in the same manner as in Example 4, except the compound of the present invention was added to the fixer instead of to the washing water. The formula of the fixer was as follows.

| | |
|---|---|
| Ammonium Thiosulfate | 150.0 g |
| Sodium Sulfite | 30.0 g |
| Acetic Acid | 30.0 g |
| Compound I-(6) (this invention) | 1.0 g |
| Water to make | 1 l |

The pH of the fixer was adjusted to 5.00 using NaOH. The sample processed in the above-described manner showed excellent photographic properties (including $D_{max}$, sensitivity, gamma value, and prevention of black spots), and had reduced color contamination (by 0.030 with respect to red density).

EXAMPLE 9

Experiments were carried out in the same manner as in Example 1, except the compounds of the present invention were changed to those set forth in Table 3, respectively.

TABLE 3

| Test No. | Present Compound Added in Washing | Amount Added (g/l) | Color Contamination after Processing | Note |
|---|---|---|---|---|
| 1 | Not added | — | 0.209 | |
| 2 | Compound II-(6) | 1.8 | 0.141 | |
| 3 | Compound II-(9) | 3.5 | 0.142 | |
| 4 | Compound II-(7) | 1.0 | 0.143 | |
| 5 | Compound II-(12) | 2.3 | 0.140 | |
| 6 | Compound II-(15) | 1.5 | 0.137 | |
| 7 | Compound II-(16) | 2.0 | 0.140 | |
| 8 | Every processing time in Test 1 was doubled, and thereby Dry to Dry time was fixed at 110 sec. | — | 0.138 | When processing times were increased, color contamination was not caused. |
| 9 | The replenishing amount of washing water in Test 1 was changed to 250 ml per one sheet of quarto-size film | — | 0.205 | Even when washing water was replenished in an increased amount, color contamination was not diminished. |
| 10 | The replenishing amount of washing water in Test 2 was changed 250 ml per one sheet of quarto-size film | 1.5 (I-(15)) | 0.139 compound in washing water | Maintaining the concentration of the present compound in washing water at the prescribed value was disadvantageous from an economical point of view. |

As can be seen from the data in Table 3, using the washing water containing the compound of the present invention enabled considerable reduction in color contamination remaining after photographic processing even when the processing was carried out very rapidly, and using reduced amounts of replenishers.

EXAMPLE 10

The same photographic materials as produced in Example 2, i.e., Samples 1001 to 1003, were processed using the automatic developing machine in the same manner as in Example 9.

| Sample No. | Sensitizing Dye (amount added: g/mol Ag) | Compound Added to Washing Water (amount added: g/l) | (Color Contamination Density without Present Compound) Minus (Color Contamination Density with Present Compound) |
|---|---|---|---|
| 1001 | A (500) | II-(15) (1.5) | 0.052 |
| 1002 | B (500) | II-(15) (1.5) | 0.048 |
| 1003 | C (400) | II-(1) (1.8) | 0.051 |

In every sample, color contamination was diminished by processing with the washing water containing the compound of the present invention.

EXAMPLE 11

Photographic processing was performed in the same manner as in Example 3, except the compound used in the washing water was replaced by 1.5 g/l of Compound II-(15). The density of color contamination remaining after the processing, which was measured in the same manner as in Example 1, was lower by 0.043 than that remaining after the processing in which none of the compounds of the present invention was used.

EXAMPLE 12

Photographic processing was carried out in the same manner as in Example 4, except the same washing water as used in Example 11 was employed. The sample processed in this manner showed excellent photographic properties (including $D_{max}$, sensitivity, gamma value, and prevention of black spots), and had a red color contamination density lower by 0.026, compared with the case wherein the washing water used did not contain the compound of the present invention.

EXAMPLE 13

Photographic processings were performed in the same manner as in Example 5, except the compounds of the present invention were replaced by those set forth in Table 4, respectively, and the fixation times were changed to those set forth in Table 4, respectively.

TABLE 4

| Present Compound Added to Fixer | Amount Added (g/l) | Color Contamination (optical transmission density) | Fixing Time (sec) |
|---|---|---|---|
| Control | — | 0.206 | 6.8 |
| Compound II-(1) | 1.8 | 0.143 | 5.3 |
| Compound II-(6) | 3.5 | 0.142 | 5.5 |
| Compound II-(7) | 1.0 | 0.146 | 5.7 |
| Compound II-(12) | 2.3 | 0.147 | 6.0 |
| Compound II-(15) | 1.5 | 0.143 | 5.9 |
| Compound II-(16) | 2.0 | 0.145 | 5.7 |

As can be seen from the data in Table 4, every fixer containing the compound of the present invention enabled reduction in density of color contamination remaining after photographic processing even when a very rapid processing was employed. In addition, an increase in fixing speed was achieved. These effects are very significant for the very rapid processing made possible by this invention.

EXAMPLE 14

The same photographic materials as produced in Example 1, i.e., Samples 1401 to 1403, were processed using the automatic developing machine under the same conditions as in Example 6, except the compounds added to the fixers used were replaced by the following compounds, respectively.

| Sample No. | Sensitizing Dye (amount added: g/mol Ag) | Compound Added to Fixer (amount added: g/l) | (Color Contamination Density without Present Compound) Minus (Color Contamination Density with Present Compound) |
|---|---|---|---|
| 1401 | A (500) | II-(1) (1.8) | 0.051 |
| 1402 | B (500) | II-(1) (1.0) | 0.050 |
| 1403 | C (400) | II-(15) (1.5) | 0.049 |

When processed with the fixer containing the compound of the present invention, each sample had reduced color contamination.

EXAMPLE 15

Photographic processing was performed in the same manner as in Example 7, except that the fixer prepared by adding one of the present compounds, II-(15), to Fixer GR-F1 in an amount of 1.0 g/l was used in place of that fixer, and color contamination remaining after the photographic processing was examined in the same manner as in Example 1. The density of color contamination remaining after this photographic processing was lower by 0.043 than that remaining after the photographic processing in which none of the present compounds was used.

EXAMPLE 16

An experiment was carried out in the same manner as in Example 8, except the compound used in the fixer was replaced by 1.5 g/l of Compound II-(15). The sample processed in the above-described manner showed excellent photographic properties (including $D_{max}$, sensitivity, gamma value, and prevention of black spots), and had a color contamination density reduced by 0.029 with respect to red color.

While the invention has been described in detail and with reference to specific embodiments thereof, it will be apparent to one skilled in the art that various changes and modifications can be made therein without departing from the spirit and scope thereof.

What is claimed is:

1. A method for processing a black-and-white photosensitive material comprising the steps of:

(a) exposing a silver halide photosensitive material having been spectrally sensitized with a sensitizing dye;

(b) developing said exposed material;

(c) fixing said developed material; and (d) thereafter at least one step selected from the group consisting of washing said material and stabilizing said material;

said fixing step being performed in the presence of at least one compound represented by formula (I) or (II) or a salt thereof:

(I)

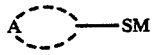

wherein A represents an atomic group necessary for forming a saturated or unsaturated 3-membered to 8-membered ring comprising at least one hetero atom selected from the group consisting of an oxygen atom, a nitrogen atom, a sulfur atom and a selenium atom; and M represents a hydrogen atom or a counter cation; and $$X-(R_1-S)_n-R_2-S-R_3-Y \quad (II)$$

wherein $R_1$, $R_2$ and $R_3$, which may be the same or different, each represents an alkylene group; $R_1$ and $R_3$ may be linked to form a ring, $R_2$ and $R_3$ may be linked to form a ring; X and Y, which may be the same or different, each represents a hydrogen atom, an alkyl group, an amino group, an ammonio group, a hydroxyl group, a carboxyl group, a sulfo group, an aminocarbonyl group or an aminosulfonyl group, and X and Y may be linked to form a ring; and n is an integer of from 0 to 10.

2. A method as claimed in claim 1, wherein said compound is represented by formula (I).

3. A method as claimed in claim 2, wherein —SM is linked to a carbon atom contained in the ring formed by A.

4. A method as claimed in claim 2, wherein said ring formed by A is a nitrogen-containing ring.

5. A method as claimed in claim 2, wherein said ring formed by A is substituted with at least one substituent selected from the group consisting of a hydroxyl group, an alkoxy group, an amino group, an ammonio group, an alkyl group, a mercapto group, an alkylthio group, a carbamoyl group, a sulfamoyl group, and one of these groups further substituted with a hydroxyl group, an alkoxy group, an amino group, an ammonio group, an alkyl group, a mercapto group, an alkylthio group, a carbomoyl group or a sulfamoyl group.

6. A method as claimed in claim 5, wherein said substituent is selected from the group consisting of an alkoxy group, an amino group, an ammonio group, an alkyl group, a mercapto group, an alkylthio group, an alkyl group substituted with an amino group, an alkyl group substituted with an ammonio group, an alkylthio group substituted with an amino group and an alkylthio group substituted with an ammonio group.

7. A method as claimed in claim 2, wherein M represents a hydrogen atom, an alkali metal atom or an organic base.

8. A method as claimed in claim 2, wherein the total number of carbon atoms contained in said compound represented by formula (I) is 30 or less.

9. A method as claimed in claim 8, wherein the total number of carbon atoms contained in said compound represented by formula (I) is 20 or less.

10. A method as claimed in claim 1, wherein said compound is represented by formula (II).

11. A method as claimed in claim 10, wherein said alkylene group represented by $R_1$, $R_2$ or $R_3$ comprises an ether group.

12. A method as claimed in claim 10, wherein said alkylene group represented by $R_1$, $R_2$ or $R_3$ contains from 1 to 10 carbon atoms; and X and Y each represents a hydrogen atom or a group containing from 1 to 10 carbon atoms.

13. A method as claimed in claim 12, wherein said alkylene group represented by $R_1$, $R_2$ or $R_3$ contains from 1 to 6 carbon atoms; and n is an integer of from 1 to 4.

14. A method as claimed in claim 10, wherein X and Y each represents a hydrogen atom, an amino group or an ammonio group.

15. A method as claimed in claim 10, wherein said compound represented by formula (II) is a salt of said compound and an inorganic or organic acid.

16. A method as claimed in claim 1, wherein said method comprises a further step of drying said material after said step (d).

17. A method as claimed in claim 16, wherein said processing from the beginning of said developing step to the end of said drying step is completed in at most 90 seconds.

18. A method as claimed in claim 17, wherein said processing from the beginning of said developing step to the end of said drying step is completed in at most 70 seconds.

19. A method as claimed in claim 1, wherein said compound represented by formula (I) or (II) is present in an amount of from about $5\times10^{-5}$ to $1\times10^{-1}$ mol per liter of solution used in said fixing step.

20. A method as claimed in claim 19, wherein said compound represented by formula (I) or (II) is present in an amount of from about $1\times10^{-4}$ to $5\times10^{-2}$ mol per liter of said solution.

21. A method as claimed in claim 20, wherein said compound represented by formula (I) or (II) is present in an amount of from about $1\times10^{-3}$ to $5\times10^{-2}$ mol per liter of said solution.

22. A method as claimed in claim 19, wherein said method comprises a further step of replenishing said washing solution or said stabilizing solution in an amount up to about 2 liter per $m^2$ of said photosensitive material processed.

23. A method as claimed in claim 17, wherein said developing step is conducted at a temperature of from about 25° to 50° C. for a time up to about 20 seconds; said fixing step is conducted at a temperature of from about 20° to 50° C. for a time of from about 6 to 20 seconds; said at least one of the washing and stabilizing steps is conducted at a temperature of from 0° to 50° C. for a time of from about 6 to 20 seconds; and said drying step is conducted at a temperature of from about 40° to 100° C. for a time of from about 5 to 30 seconds.

24. A method as claimed in claim 23, wherein said developing step is conducted at a temperature of from about 30° to 40° C. for a time up to about 15 seconds; said fixing step is conducted at a temperature of from about 30° to 40° C. for a time of from about 6 to 15 seconds; said at least one of the washing and stabilizing steps is conducted at a temperature of from 15° to 40° C. for a time of from about 6 to 15 seconds; and said drying step is conducted at a temperature of from about 40° to 80° C. for a time of from about 5 to 20 seconds.

* * * * *